US009574317B2

(12) United States Patent
MacDonald

(10) Patent No.: US 9,574,317 B2
(45) Date of Patent: Feb. 21, 2017

(54) WALL BLOCK AND WALL BLOCK SYSTEM

(71) Applicant: Robert A. MacDonald, Plymouth, MN (US)

(72) Inventor: Robert A. MacDonald, Plymouth, MN (US)

(73) Assignee: KEYSTONE RETAINING WALL SYSTEMS LLC, West Chester, OH (US)

( * ) Notice: Subject to any disclaimer, the term of this patent is extended or adjusted under 35 U.S.C. 154(b) by 0 days.

(21) Appl. No.: 14/861,224

(22) Filed: Sep. 22, 2015

(65) Prior Publication Data

US 2016/0010307 A1 Jan. 14, 2016

Related U.S. Application Data

(63) Continuation of application No. 13/864,836, filed on Apr. 17, 2013, now abandoned.

(60) Provisional application No. 61/635,561, filed on Apr. 19, 2012.

(51) Int. Cl.

| | |
|---|---|
| ***E02D 29/02*** | (2006.01) |
| ***E02D 3/10*** | (2006.01) |
| ***E04B 2/02*** | (2006.01) |
| ***E04C 1/39*** | (2006.01) |

(52) U.S. Cl.

CPC ..... *E02D 29/02* (2013.01); *E02D 3/10* (2013.01); *E02D 29/025* (2013.01); *E02D 29/0208* (2013.01); *E04B 2/02* (2013.01); *E04C 1/39* (2013.01); *E04B 2002/0202* (2013.01)

(58) Field of Classification Search

CPC .... E02D 29/02; E02D 29/0208; E02D 29/025; E02D 3/10; E04B 2/02; E04C 1/39

USPC ..... 52/604, 606, 607, 608; 405/284, 286

See application file for complete search history.

(56) References Cited

U.S. PATENT DOCUMENTS

| | | | |
|---|---|---|---|
| 1,385,299 | A | 7/1921 | Bilque |
| D296,007 | S | 5/1988 | Forsberg |
| D301,064 | S | 5/1989 | Forsberg |
| D319,885 | S | 9/1991 | Blomquist et al. |
| D321,060 | S | 10/1991 | Blomquist et al. |

(Continued)

FOREIGN PATENT DOCUMENTS

| | | |
|---|---|---|
| EP | 0 322 667 A1 | 7/1989 |
| WO | WO 03/006749 A2 | 1/2003 |

OTHER PUBLICATIONS

Abstract for EP 0 322 667 A1 (1 page). Jul. 5, 1989.

Mar. 28, 2014 International Search Report and Written Opinion for Application No. PCT/US2013/036929 (10 pages).

*Primary Examiner* — Adriana Figueroa

*Assistant Examiner* — Jessie Fonseca

(74) *Attorney, Agent, or Firm* — Popovich, Wiles & O'Connell, P.A.

(57) ABSTRACT

A wall block, wall block system and method of making a wall block. The wall block including at least one core extending from the top surface to the bottom surface, the at least one core having opposed front and rear surfaces and first and second side surfaces the wall block also including at least one pin hole opening onto the top surface of the block and extending at least a portion of the distance from the top surface to the bottom surface. The at least one pin hole may open onto at least a portion of at least one surface of the at least one core. The block may be provided with channels; the pin hole, channels and core may all be formed in a mold box by a single forming member.

17 Claims, 16 Drawing Sheets

(56) References Cited

U.S. PATENT DOCUMENTS 5,161,918 A 11/1992 Hodel
5,214,898 A 6/1993 Beretta
5,252,017 A 10/1993 Hodel
D341,215 S 11/1993 Blomquist et al.
D346,667 S 5/1994 Blomquist et al.
D347,070 S 5/1994 Anderson et al.
D350,402 S 9/1994 Pribyl et al.
5,421,135 A * 6/1995 Stevens ..... E04B 2/16 405/284
5,568,994 A 10/1996 Dawson
5,575,128 A * 11/1996 Haener ..... E04B 2/18 52/100
5,595,460 A 1/1997 Miller et al.
5,601,384 A 2/1997 Dawson
5,619,835 A 4/1997 Bailey, II et al.
D380,560 S 7/1997 Forsberg
D381,086 S 7/1997 Forsberg
D384,168 S 9/1997 Stevenson
D387,434 S 12/1997 Dawson
5,707,184 A 1/1998 Anderson et al.
5,735,643 A * 4/1998 Castonguay ..... E02D 29/0266 405/284
D397,230 S 8/1998 Forsberg
D397,451 S 8/1998 Stevenson
D397,808 S 9/1998 Dawson
5,865,006 A 2/1999 Dawson
5,913,790 A 6/1999 Dawson
5,941,042 A 8/1999 Dueck
5,984,589 A * 11/1999 Ciccarello ..... E02D 29/0266 405/262
6,019,550 A 2/2000 Wrigley et al.
6,035,599 A 3/2000 Sonnentag
6,082,067 A * 7/2000 Bott ..... E04B 2/16 52/421
D430,308 S 8/2000 Dawson
D433,158 S 10/2000 Hammer
6,149,352 A 11/2000 MacDonald
D439,678 S 3/2001 Blomquist et al.
RE37,278 E * 7/2001 Forsberg ..... E02D 29/025 52/585.1
D452,332 S 12/2001 Blomquist et al.
D458,387 S 6/2002 Blomquist et al.
6,464,432 B1 10/2002 Shaw
D467,009 S 12/2002 Agee
6,488,448 B1 12/2002 Blomquist et al.
6,527,483 B1 3/2003 Agee
6,536,994 B2 3/2003 Race
6,591,569 B2 7/2003 Azar
D479,003 S 8/2003 Nordstrand
6,615,561 B2 * 9/2003 MacDonald ..... E02D 29/025 52/606
6,622,445 B1 9/2003 Shillingburg et al.
6,701,687 B1 * 3/2004 Shillingburg ..... E02D 29/0241 405/284
6,709,201 B2 3/2004 Race
D488,242 S 4/2004 MacDonald
D488,568 S 4/2004 MacDonald
D488,569 S 4/2004 Dawson
D490,542 S 5/2004 MacDonald
6,803,002 B2 10/2004 Suto et al.
6,821,058 B1 * 11/2004 Dawson ..... E02D 29/025 405/284
D501,935 S 2/2005 Dawson et al.
6,854,231 B2 2/2005 MacDonald et al.
6,912,823 B2 7/2005 MacDonald et al.
7,096,634 B2 8/2006 Dean, Jr.
7,168,892 B1 1/2007 MacDonald et al.
D556,919 S 12/2007 Price
7,328,537 B2 * 2/2008 Hammer ..... E02D 29/025 52/585.1
D574,517 S 8/2008 Foster
7,448,830 B2 11/2008 MacDonald et al.
7,641,178 B2 1/2010 MacDonald et al.
D610,710 S 2/2010 LaCroix et al.
7,654,776 B2 2/2010 MacDonald et al.
7,665,269 B2 2/2010 Azar
D615,669 S 5/2010 Caggiano
D620,135 S 7/2010 Adam
D620,615 S 7/2010 MacDonald et al.
D621,070 S 8/2010 MacDonald et al.
7,780,141 B2 8/2010 Dawson et al.
7,934,351 B2 5/2011 Clarno
7,971,407 B2 7/2011 MacDonald
D645,575 S 9/2011 Bone
D647,218 S 10/2011 MacDonald
D647,219 S 10/2011 MacDonald
D663,858 S 7/2012 MacDonald
D665,514 S 8/2012 MacDonald
D665,515 S 8/2012 MacDonald
D667,138 S 9/2012 Rainey
2001/0004822 A1 * 6/2001 Martin ..... E02D 29/025 52/596
2002/0001509 A1 1/2002 Hong
2002/0083657 A1 * 7/2002 Mattox ..... E02D 29/025 52/125.2
2002/0182015 A1 * 12/2002 Shaw ..... E02D 29/0241 405/284
2002/0192035 A1 * 12/2002 MacDonald ..... E02D 29/0266 405/284
2003/0002925 A1 * 1/2003 Blomquist ..... E02D 29/025 405/284
2003/0012608 A1 * 1/2003 Race ..... E02D 29/0241 405/284
2003/0012609 A1 * 1/2003 Woolford ..... B28B 7/0097 405/284
2003/0029114 A1 * 2/2003 MacDonald ..... E02D 29/0283 52/562
2003/0079432 A1 * 5/2003 Azar ..... E04B 2/16 52/604
2005/0102949 A1 5/2005 Whitson
2005/0279046 A1 * 12/2005 Gravier ..... E02D 29/0241 52/604
2006/0110223 A1 5/2006 Dawson
2008/0148676 A1 * 6/2008 Azar ..... E04B 2/16 52/604
2008/0260474 A1 * 10/2008 Koster ..... E04C 1/395 405/284
2008/0277561 A1 11/2008 MacDonald
2008/0289282 A1 11/2008 MacDonald
2008/0302350 A1 12/2008 LaCroix
2008/0307740 A1 12/2008 MacDonald
2008/0313988 A1 12/2008 MacDonald
2009/0120029 A1 5/2009 LaCroix et al.
2009/0151281 A1 6/2009 MacDonald et al.
2009/0188196 A1 7/2009 MacDonald
2009/0288354 A1 * 11/2009 Donohew ..... B28B 7/0061 52/220.1
2009/0308015 A1 12/2009 MacDonald et al.
2009/0313936 A1 12/2009 MacDonald et al.
2010/0284751 A1 * 11/2010 Price ..... E04C 1/395 405/284
2010/0308502 A1 12/2010 LaCroix et al.
2010/0310695 A1 12/2010 LaCroix et al.
2011/0072753 A1 3/2011 MacDonald
2011/0217127 A1 9/2011 MacDonald
2011/0243669 A1 10/2011 Friederichs et al.

* cited by examiner

WALL BLOCK AND WALL BLOCK SYSTEM

This application is a continuation of U.S. Ser. No. 13/864,836, filed Apr. 17, 2013, now abandoned, which claims the benefit of U.S. Provisional Application No. 61/635,561, filed Apr. 19, 2012, entitled "Wall Block and Wall Block System", the contents of each of which are hereby incorporated by reference herein.

FIELD OF THE INVENTION

This invention relates generally to wall blocks, and walls constructed from the wall blocks. This invention also relates to mold boxes and forming members for the mold boxes in the manufacture of the wall blocks.

BACKGROUND OF THE INVENTION

Retaining walls are used in various landscaping projects and are available in a wide variety of styles. Numerous methods and materials exist for the construction of retaining walls. Such methods include the use of natural stone, poured concrete, precast panels, masonry, and landscape timbers or railroad ties.

In recent years, segmental concrete retaining wall units, which are dry stacked (i.e., built without the use of mortar), have become widely accepted in the construction of retaining walls. Such retaining wall units have gained popularity because they are mass produced and, consequently, relatively inexpensive. They are structurally sound, easy and relatively inexpensive to install, and couple the durability of concrete with the attractiveness of various architectural finishes.

The shape of the block is also an important feature during installation of a retaining wall. Many commercially available blocks are symmetrical about a plane bisecting the front and back surfaces. Typically such blocks have planes rather than axes of symmetry, as there are differences between the top and bottom surfaces of such blocks. Clearly, blocks that are substantially square or rectangular (i.e., each surface being joined to another at an orthogonal angle) exhibit a great deal of symmetry. There are advantages to having non-parallel surfaces on these blocks when constructing a retaining wall. The angles formed by these side surfaces permits construction of curvilinear walls, and moreover, permit the amount of curvature to vary according to the terrain and desired appearance of the retaining wall.

In the manufacture of retaining wall blocks and other kinds of blocks made from concrete, it is common to use a mold that forms a block module which is then split to form two or more blocks. When a block module is split, the split surface has an irregular appearance, which is desirable if the desired look is one of natural stone. In forming block modules of such blocks, it is often standard practice to split a block module on a plane coincident with the front faces of two blocks, thus giving the front faces of two opposing blocks an irregular (i.e., roughened) appearance.

Additionally during the manufacture of the block, separate core support bridges (similar to core bars) help support interior void forming elements such as open cores, pin holes and the like, which span the cavity of the mold during production and allow the concrete to flow around and under these support bridges. Regular over the top of mold core bars may leave undesired troughs or blemishes on the surface of the block where the core bars pass over the face or surface area of the block. Numerous core bars in a mold may result in inconsistent material distribution inside the mold cavity and can create problems in achieving good compression results in the concrete material.

Another important feature of retaining wall blocks and blocks used in free standing walls is the appearance of the block. Creating a uniform and consistent look is very appealing for walls. Additionally, the look of weathered natural stone is very appealing for walls. There are several methods in the art to produce concrete wall blocks having an appearance that to varying degrees mimics the look of natural stone. One well known method is to split the block during the manufacturing process so that the front face of the block has a fractured concrete surface that looks like a natural split rock. This is done by forming a single large unit in the mold cavity and providing one or more splitting grooves in the single unit to function as one or more splitting planes. The single unit is then split apart to form two or more blocks. Another method is wherein blocks are individually formed in a mold and the surfaces are textured by removal of the mold. Another known method of creating a block having an irregular or textured surface is to form the block in a mold box that has been provided with a sidewall liner shaped to impart the irregular or textured surface on the block during the block molding process.

Wall block systems are also generally provided with some means to connect blocks in adjacent courses of the wall, such as a pinning system. The pinning system generally connects adjacent courses in a wall together thereby strengthening the wall and increasing stability of the structure. The pinning system can also align the courses of adjacent blocks to produce a set-back or a near vertical wall.

It would be desirable to provide a wall block having full depth cores which lighten the block weight for use in constructing a wall, retaining wall, fence or the like.

It would be desirable to provide a wall block having a chamfer on the sides and top of the front face of the block, to reduce the probability of sustaining damage to the block edges during manufacture, plant-handling, transportation and site installation handling. It would further be desirable that the sides and top of the front face of the wall block have an angled chamfer which creates block edges that are greater than 90° from a vertical plane formed from the sides and front of the block. The greater than 90° edges are harder to chip off or wear away during manufacture, plant-handling, transportation and site installation handling, and thereby minimize any damage to block edges.

It would be desirable to provide a system of blocks for constructing a wall that combines the ease of installation of modern segmental wall blocks with the attractive appearance of an aesthetic design. It would also be desirable to provide a retaining wall system that allows an aesthetically pleasing uniform appearance.

It would further be highly desirable to have a wall block system which can be used to build a retaining wall using a pin connection between courses, depending on the requirements of the project. Such a unit would also be desirable from a production and distribution view point, because the same block design could be used in multiple wall applications, thus reducing the need to produce specialty units.

It would be further desirable to provide a wall block system for the construction of a wall, retaining wall and the like having a pin connection system whereby the courses of the wall being constructed are aligned by a core of the block when the inserted pin of the pinning system engages a wall of the core of the block. This method of supporting the pin core is also a benefit in that it eliminates the need for additional core bars or supporting bridges.

It would be further desirable to provide a wall block system for the construction of a wall, retaining wall and the like having a pin connection system that may allow setback of the structure being constructed. It would be further desirable to provide a wall block system for the construction of a wall, retaining wall and the like having a pin connection system that may allow near vertical construction of the structure.

It would further be desirable to provide a mold box utilizing a recessed forming member to produce a core rather than a standard core bar as known in the art. It would further be desirable to provide a mold box utilizing a recessed forming member that can produce a core and a pin hole. It would further be desirable to provide a mold box utilizing a recessed forming member that can produce a core, pin hole and receiving channel.

SUMMARY OF THE INVENTION

A wall block including a block body having opposed front and rear faces, opposed first and second side walls, and opposed and substantially parallel top and bottom surfaces. The wall block also including at least one core extending from the top surface to the bottom surface, having opposed front and rear surfaces and first and second side walls. The wall block including at least one pin hole opening onto the top face of the block and extending at least a portion from the top surface to the bottom surface, the at least one pin hole opening into at least a portion of at least one surface of the at least one core.

The front face of the wall block may have an angular surface that is adjacent and non-orthogonal to the top surface. The front face may also have an angular surface that is adjacent and non-orthogonal to at least one of the opposed first and second side walls. The front face may also have an angular surface that is adjacent and non-orthogonal to the first side wall and has an angular surface that is adjacent and no-orthogonal to the second side wall.

The wall block may further include two cores having opposed front and rear surfaces and first and second side walls. The wall block may further include that the top surface has a first and a second elongate channel, the first elongate channel extending from the first side wall of the core to the first side wall of the block body and the second elongate channel extending from the second side wall of the core to the second side wall of the block body. The wall block may further include that the top surface has first, second, third and fourth elongate channels, the first elongate channel extending from the first side wall of the first core to the first side wall of the block body, the second elongate channel extending from the second side wall of the first core to the second side wall of the block body, the third elongate channel extending from the first side wall of the second core to the first side wall of the block body and the fourth elongate channel extending from the second side wall of the second core to the second side wall of the block body.

The pin hole of the wall block may open onto the rear surface of the core. The wall block may further include at least two pin holes, wherein at least one pin hole opens into at least a portion of at least one surface of the first core and at least one pin hole opens into at least a portion of at least one surface of the second core.

The wall block may include that the opposed first and second side walls are non-orthogonal to the front and back faces.

A wall block including a block body having opposed front and rear faces, opposed first and second side walls, and opposed and substantially parallel top and bottom surfaces. The wall block further includes at least one core extending from the top surface to the bottom surface, the at least one core having opposed front and rear surfaces and first and second side surfaces and at least one pin hole opening onto the top surface of the block and extending at least a portion of the distance from the top surface to the bottom surface, the at least one pin hole opening onto at least a portion of at least one surface of the at least one core.

The wall block may include that the front face has an angular surface that is adjacent and non-orthogonal to the top surface and may further include that the front face has at least one angular surface that is adjacent and non-orthogonal to at least one of the opposed first and second side wall. The wall block may further include that the front face has an angular surface that is adjacent and non-orthogonal to the first side wall and has an angular surface that is adjacent and no-orthogonal to the second side wall or the wall block may include that the front face has at least one angular surface that is adjacent and non-orthogonal to at least one of the opposed first and second side walls.

The wall block may include that the top surface has a first and a second elongate channel, the first elongate channel extending from the first side surface of the core to the first side wall of the block body and the second elongate channel extending from the second side surface of the core to the second side wall of the block body.

The wall block may include two cores having opposed front and rear surfaces and first and second side surfaces and the wall block may further include that the top surface has first, second, third and fourth elongate channels, the first elongate channel extending from the first side surface of the first core to the first side wall of the block body, the second elongate channel extending from the second side surface of the first core to the second side wall of the block body, the third elongate channel extending from the first side surface of the second core to the first side wall of the block body and the fourth elongate channel extending from the second side surface of the second core to the second side wall of the block body. The wall block may further include that the at least one pin hole is two pin holes that open onto the rear surface of the first core or may include that the at least one pin hole is two pin holes that open onto the first and second side surface of the first core.

The wall block may include that the opposed first and second side walls are non-orthogonal to the front and back faces.

A wall block including a block body having opposed front and rear faces, opposed first and second side walls, and opposed and substantially parallel top and bottom surfaces, the opposed first and second side walls being non-orthogonal to the front and back faces, the front face of the block having a front portion substantially parallel to the opposed rear face, a first angled portion extending non-orthogonal from the top surface, a second angled portion extending non-orthogonal from the first side wall and a third angled portion extending non-orthogonal from second side wall. The wall block further includes at least one core extending from the top surface to the bottom surface, having opposed front and rear surfaces and first and second side surfaces and at least one pin hole opening onto the top face of the block and extending at least a portion of the distance from the top surface to the bottom surface.

The wall block may include that the top surface has a first and a second elongate channel, the first elongate channel extending from the first side surface of the core to the first side wall of the block body and the second elongate channel extending from the second side surface of the core to the second side wall of the block body.

The wall block may include two cores having opposed front and rear surfaces and first and second side surfaces and the wall block may further include that the top surface has first, second, third and fourth elongate channels, the first elongate channel extending from the first side surface of the first core to the first side wall of the block body, the second elongate channel extending from the second side surface of the first core to the second side wall of the block body, the third elongate channel extending from the first side surface of the second core to the first side wall of the block body and the fourth elongate channel extending from the second side surface of the second core to the second side wall of the block body. The wall block may further include that the at least one pin hole is two pin holes that open onto the rear surface of the first core or may include that the at least one pin hole is two pin holes that open onto the first and second side surface of the first core.

A mold assembly for use in producing wall blocks including a horizontally oriented planar bottom member, first and second opposing side walls each having at least one groove on a top surface and first and second opposing end walls. The mold assembly further including a center wall having at least one groove on a top surface, the center wall having a first end adjacent the first end wall and a second end adjacent the second end wall, the first side wall, end walls and center wall being joined to form a first mold cavity, the second side wall, end walls and center walls being joined to form a second mold cavity, the bottom member enclosing a bottom of the first and second mold cavities, a top of the first and second mold cavities being open. The mold assembly further including at least two forming members each having core forming portions, at least one forming member positioned in the first mold cavity and having a first end accepted into the at least one groove of the first side wall and a second end accepted into the at least one groove of the center wall, and at least one forming member positioned in the second mold cavity and having a first end accepted into the at least one groove of the center wall and a second end accepted into the at least one groove of the second side wall.

The mold assembly may further include that the at least two forming members each have at least one pin hole forming portions and may further include that the at least two forming members have channel forming portions.

The mold assembly may include that the at least one groove on the top surface of the side walls and center wall is at least two grooves, the at least two forming members is at least four forming members with at least two forming members positioned in the first mold cavity and at least two forming members positioned in the second mold cavity. The mold assembly may include that the at least one groove on the top surface of the side walls and center wall is at least four grooves, the at least two forming members is at least eight forming members with at least four forming members positioned in the first mold cavity and at least four forming members positioned in the second mold cavity.

A method of making blocks including placing a mold over a horizontal pallet, the mold including first and second opposing side walls each having at least two grooves on a top surface, first and second opposing end walls, a center wall having at least two grooves on a top surface, the first side wall, end walls and center wall being joined to form a first mold cavity, the second side wall, end walls and center walls being joined to form a second mold cavity, the bottom member enclosing a bottom of the first and second mold cavities, a top of the first and second mold cavities being open, and at least four forming members each having a core forming portion, at least two forming members positioned in the first mold cavity and having a first end accepted into one of the grooves of the first side wall and a second end accepted into one of the grooves of the center wall, at least two forming members positioned in the second mold cavity and having a first end accepted into one of the grooves of the center wall and a second end accepted into one of the grooves of the second side wall. The mold also includes filling the mold cavities with a moldable material to form a first slab in the first mold cavity and a second slab in the second mold cavity and applying downward pressure with a stripper head assembly to remove the first and second slabs from the mold. The mold further including curing the first and second slabs, splitting the first slab into first and second blocks and splitting the second slab into third and fourth blocks, each of the first, second, third and fourth blocks having opposing and parallel first and second face surfaces, opposing first and second side walls, and at least one core.

The method may further include that the at least four forming members each have at least one pin hole forming portion and wherein each of the first, second, third and fourth blocks have at least one pin hole. The method may include that the at least one pin hole forming portion is two pin hole forming portions and wherein each of the first, second, third and fourth blocks have two pin holes. The method may include that the at least four forming members have channel forming portions and wherein each of the first, second, third and fourth blocks have at least one channel.

The method may include the at least two grooves on the top surface of the side walls and center wall is at least four grooves, the at least four forming members is at least eight forming members with at least four forming members positioned in the first mold cavity and at least four forming members positioned in the second mold cavity and wherein each of the first, second, third and fourth blocks have two cores. The method may further include that four of the forming members each have at least one pin hole forming portion and wherein each of the first, second, third and fourth blocks have at least one pin hole. The method may include that the at least eight forming members have channel forming portions and wherein each of the first, second, third and fourth blocks have at least one channel.

The method may include that the stripper head assembly has an angular plate that imprints an angular surface on the first and second slabs and wherein the first, second, third and fourth blocks have at least one angular surface.

BRIEF DESCRIPTION OF THE DRAWINGS

A preferred form of the present invention will now be described by way of example with reference to the accompanying drawings, wherein.

DETAILED DESCRIPTION OF THE PREFERRED EMBODIMENTS

Figure 1:
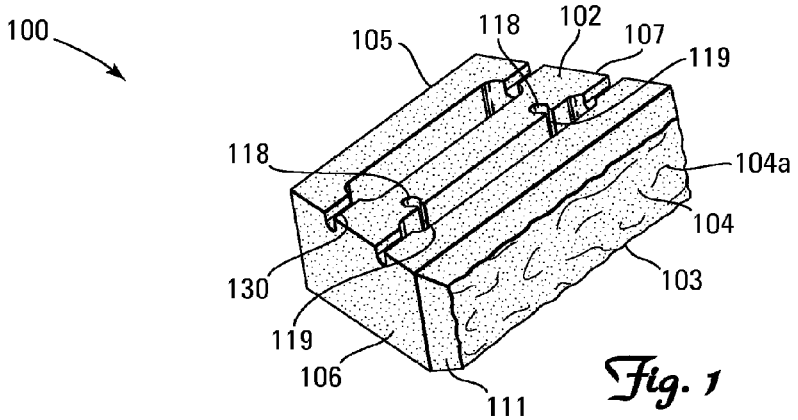
FIGS. 1 to 7 are top perspective, front, top, bottom, back and side views, respectively, of an embodiment of a wall block.
Figure 2:
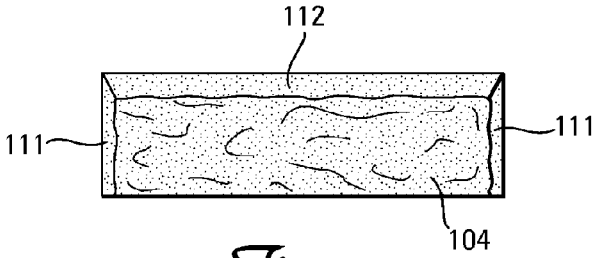
Figure 3:
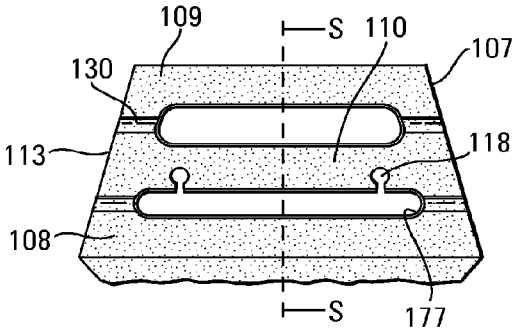
Figure 4:
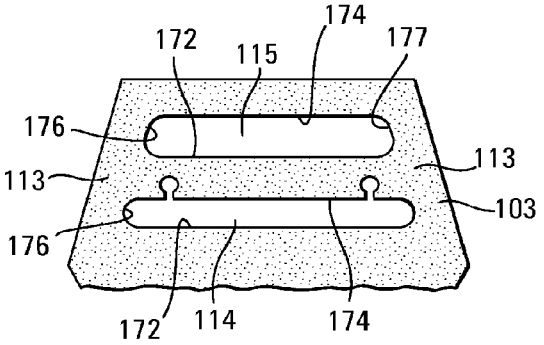
Figure 5:
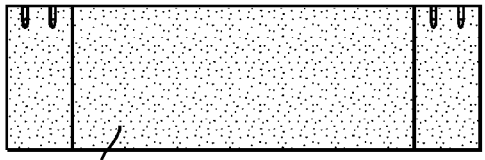
Figure 6:
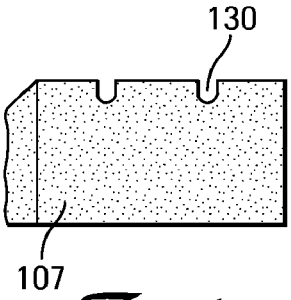
Figure 7:
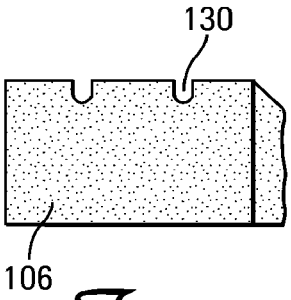

In this application, "upper" and "lower" refer to the placement of the block in a wall, retaining wall, fence and the like. The lower surface faces down, that is, it is placed such that it faces the ground. In forming a wall, one row of blocks is laid down, forming a course. A second course is laid on top of this by positioning the lower surface of one block on the upper surface of another block. The wall blocks of this invention may be symmetrical about a vertical plane of symmetry. The blocks are provided with pin holes and at least one core which may serve as a pin receiving cavity. The blocks may also be provided with a receiving channel. The location, shape, and size of the pin holes, optional receiving channels and core are selected to maximize the strength of the block, as described by reference to the drawings. It is also to be understood that the pin holes, receiving channels and cores in addition to pins described below could also be used on different block types and block shapes to form different walls and that the block shown with these features does not limit the scope of the invention.

An embodiment of the wall block is shown in FIGS. 1 to 7. Block 100 is made of a rugged, weather resistant material; preferably (and typically) zero-slump molded concrete. Other suitable materials include plastic, reinforced fibers, composite polymers, wood, metal and stone. Block 100 has a block body having parallel top surface 102 and bottom surface 103, front face 104, rear face 105 and first and second side walls 106 and 107. Front face 104 and rear face 105 each extend from top face 102 to bottom face 103. Side walls 106 and 107 extend from top surface 102 to bottom surface 103, converging from front face 104 toward rear face 105. Front face 104 may be of a compound shape with angled surfaces or bevels 111 which are non-orthogonal to side walls 106 and 107 and angled surface or bevel 112 which is non-orthogonal to top surface 102. Front face 104 also includes front portion 104*a* that is parallel to rear face 105, non-orthogonal to angled surfaces 111 and 112 and orthogonal to bottom surface 103. Front face 104 protrudes from the block body and may be ⅝ inch to 1 inch thick and may more particularly be ¾ inch thick. Angled surfaces or bevels 111 and 112 may have any angular degree of slope or convergence as desired and may be greater than 90° from a vertical plane formed by the side walls 106 and 107 and front face 104. For example, angled surface 112 may be sloped at a 45 degree angle from top surface 102 so that it forms an angle of 135 degrees with respect to front face 104. Further, angled surfaces 111 may be angled 105 to 120 degrees from side walls 106 and 107. Block 100 is generally symmetrical about vertical plane of symmetry S, shown in FIG. 3. It should be understood that block 100 is not limiting and that block 100 could have any desired shape and that the thickness of the front face could be any desired dimension. It should be further understood that front face 104 could have any shape, pattern or texture and could be manufactured without angled surfaces or bevels 111 and/or 112.

Block 100 includes openings or cores 114 and 115 that may extend from top surface 102 to bottom surface 103, or may only extend partially through block 100, i.e., open to top surface 102 but closed at bottom surface 103. Cores 114 and 115 divide block 100 into front portion 108, back portion 109 and center portion 110. Cores 114 and 115 reduce the weight of block 100. Lower block weight is both a manufacturing advantage and a constructional advantage when building a wall from the wall blocks as it reduces cost due to less material and makes lifting of the blocks easier. Cores 114 and 115 have opposed front and rear surfaces 172 and 174, respectively. Front surface 172 of each respective core being located in a closer proximity to front face 104 then rear surface 174 of each respective core. Rear surface 174 of each respective core being located in a closer proximity to rear face 105 than front surface 172 of each respective core. Cores 114 and 115 have first and second side walls 176 and 177. Core side walls 176 are located in proximity to side wall 106 and core side walls 177 are located in proximity to side wall 107. In the embodiment shown in FIGS. 1 to 7 core 114 has a depth from front to back as measured between faces 172 and 174 which is less than the depth of core 115. In this embodiment center portion 110 has a depth from front to back as measured between back surface 174 of core 114 and front surface 172 of core 115 which is less than the depth of back portion 109 as measured between back surface 174 of core 115 and rear face 105. In other embodiments not shown cores 114 and 115 may be of equal depth and the depth of the center and back portions may be unequal. Cores 114 and/or 115 may also be utilized as pin receiving cavities, accepting a top portion or head of a pin in a lower course of blocks in the construction of a wall and is discussed further below. Block 100 also includes neck portions 113 adjacent side walls 106 and 107, extending from front portion 108 to center portion 110 and to back portion 109. Front face 104 may form part of front portion 108, while rear face 105 may form part of back portion 109.

Figure 8:
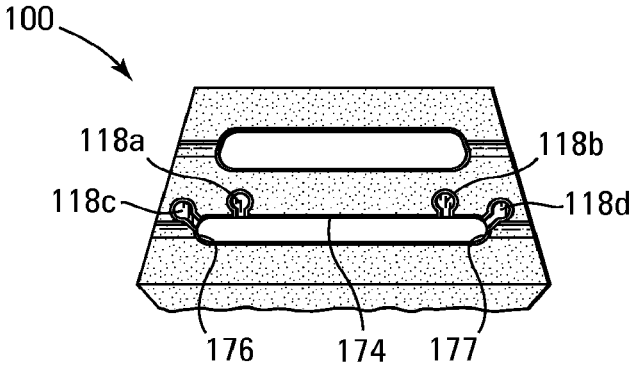
FIGS. 8 and 9 are top views of optional pin hole placement of the block of FIGS. 1 to 7.
Figure 9:
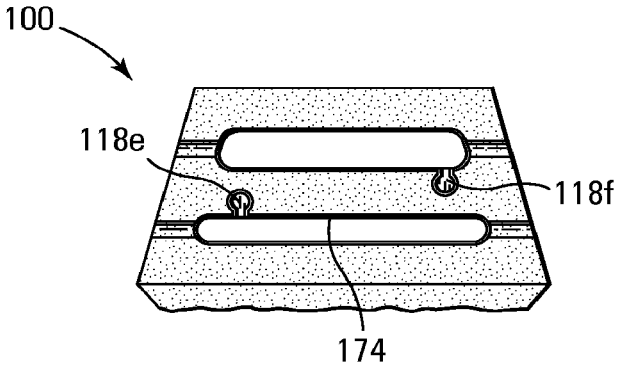
Figure 10:
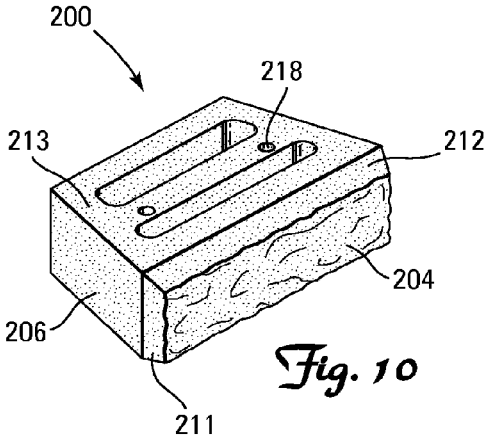
FIGS. 10 to 15 are top front perspective, top, bottom, back and side views, respectively, of a second embodiment of a wall block.
Figure 11:
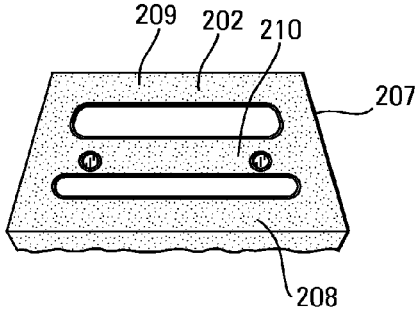
Figure 12:
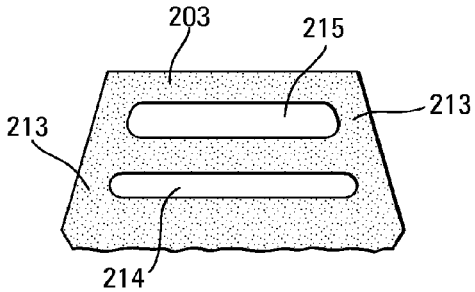
Figure 13:
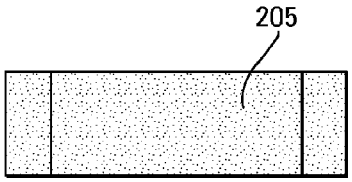
Figure 14:
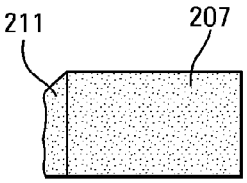
Figure 15:
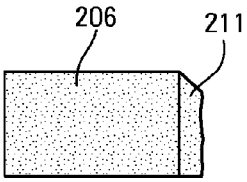

First and second pin holes 118 are located in center portion 110 and extend through block 100; open to top surface 102 and bottom surface 103. First and second pin holes 118 also open into the rear surface 174 of core 114, which is located in closer proximity to front face 104 than is core 115. The openings of pin holes 118 into rear surface 174 of core 114 extend from the top surface 102 towards the bottom surface 103 and form elongate slots 119 having a lateral width as measured in a direction between side walls 106 and 107 which is less than the maximum lateral width of the pin holes 118. The pins used with this block are dimensioned to fit within the pin holes but are larger than the opening of the pin hole into surface 174 so that the pin is securely retained within the pin hole. It should be understood that this is not limiting and that block 100 can be manufactured with the pin holes extending from top surfaces 102 through any desired distance toward bottom surface 103, i.e., open to the top surface but not open to the bottom surface. Further pin holes 118 may be manufactured to open into any surface of core 115 and/or any surface of core 114 or may be manufactured to be closed to both cores. The pin hole interior surfaces may be tapered from wider to narrower from the top surface to the bottom surface or its interior surfaces may be non-tapered or plumb. This taper of the surfaces of the pin holes is used in the manufacturing phase to help ease the removal of the block unit from the mold. The taper creates a draft angle which helps strip the pin hole forming core with greater ease from the block in the mold while helping to maintain the integrity of the shape of the pin hole. The pin holes 118 may be positioned such that they are located farther away from the line of symmetry S and closer to side walls 106 and 107. It should be noted that additional pin holes can be provided, if desired, so as to provide for further choices of predetermined setback when building a wall. Additionally, the location of the pin holes in the body of the block may be varied as desired and could, for example, be located in front portion 108, back portion 109 or neck portions 113. For example, FIGS. 8 and 9 illustrate optional embodiments of pin hole placement on block 100. FIG. 8 shows four pin holes 118*a/b/c/d* that could be positioned on the block as desired depending upon the application. Pin holes 118*a* and 118*b* may open onto rear surface 174 of core 114. Pin holes 118*c* and 118*d* may open onto side surfaces 176 and 177 of core 114. Pin holes 118*a* and 118*b* may be configured to allow the block a desired setback from a lower adjacent course when constructing a wall and pin holes 118*c* and 118*d* may be configured to allow the blocks of adjacent courses a substantially vertical configuration when utilizing the pinning structure described below. FIG. 9 shows two pin holes 118*e* and 118*f*. Pin hole 118*e* may open onto rear surface 174 of core 114. Pin hole 118*f* may open onto front surface 182 of core 115. Pin hole 118*e* may be configured to allow the block a desired setback from a lower adjacent course when constructing a wall and pin hole 118*f* may be configured to allow the block a larger desired setback from a lower adjacent course when constructing a wall when utilizing the pinning structure described below.

Figure 24:
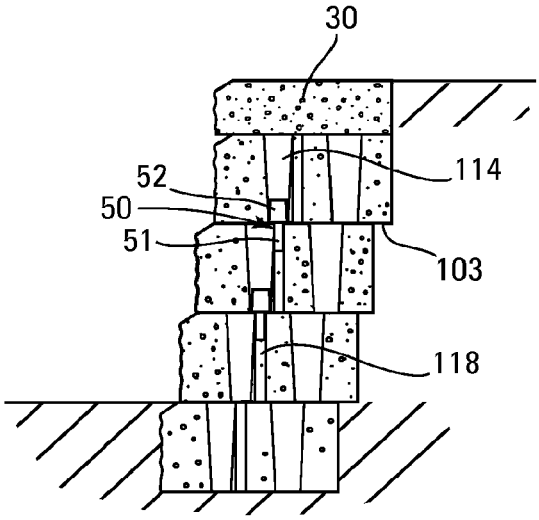
Figure 25:
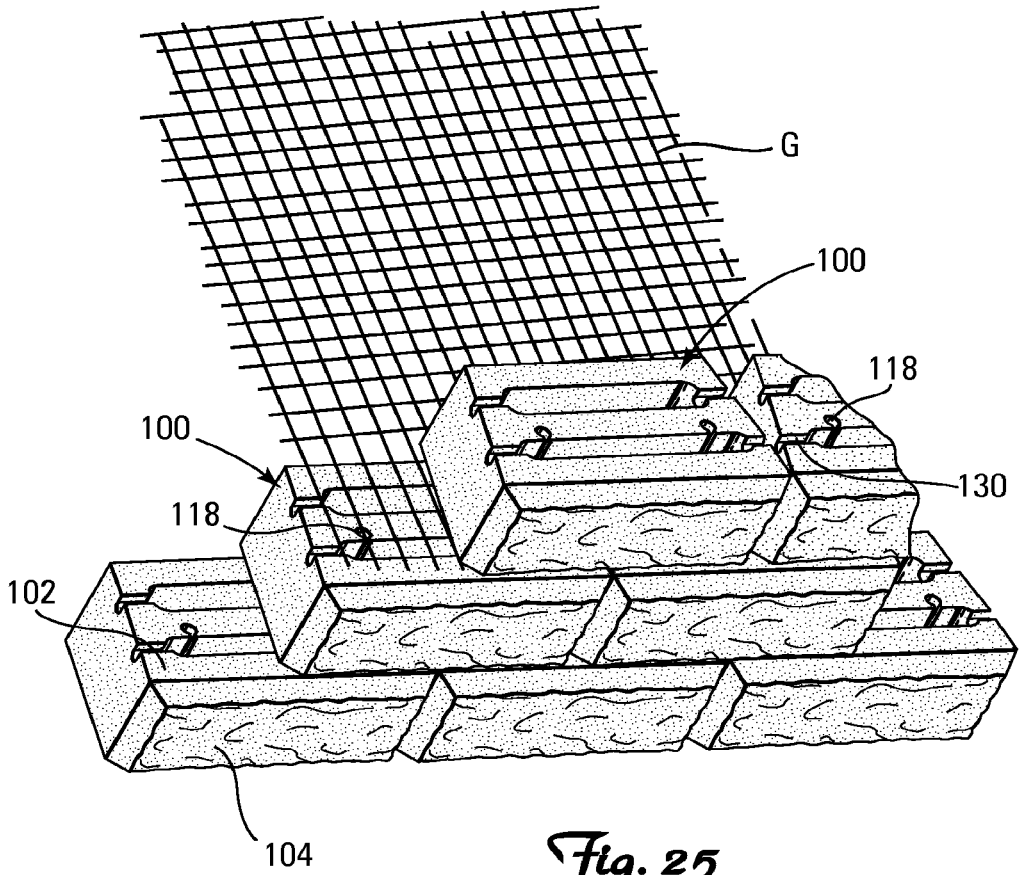
FIG. 25 is a top front perspective view of a wall constructed with geogrid soil reinforcement material, and the wall blocks of FIGS. 1 to 7.

Pin holes are sized to receive pin 50 which is shown in FIG. 24. Pin 50 has a shaft 51 which is placed into a pin hole of the top surface of block 100 in a lower course of blocks when constructing a wall. Pin 50 also has a head 52, which may have a larger diameter than the shaft 51 and may also be tapered, square, round or any other desired shape. Additionally the shaft 51 of the pin may be circular, square or any other desired shape as well. In this manner, the pin inserted into a pin hole on a lower course of blocks in a wall engages a core of a block in an upper course. This results in an interlocking of the blocks with a predetermined setback. It is to be understood that the shape of the pin is not limiting and could be for example uniformly shaped with no head or could have any other number of features.

Top surface 102 has receiving channels 130 located in neck portions 113. Receiving channels 130 extend from side wall 106 to core side wall 176 of cores 114 and 115. Receiving channels 130 also extend from side wall 107 to core side wall 177 of cores 114 and 115. Thus, block 100 includes two channels extending through the entire length of the block body, from sidewall 106 through cores 114 and 115 and to side wall 107. Receiving channels 130 are located on the top surface 102 and are formed from a bridge styled core support or forming member that is mounted to a side wall or liner of a mold cavity. During the manufacturing of block 100, concrete or other desired material settles and is vibratory compacted around the forming member. The block is then stripped from the mold cavity, forming receiving channels 130, along with cores 114 and 115. Depending upon the application, receiving channels may be of sufficient width and depth as to accommodate a channel bar or other connection means for securing geogrid to the courses of blocks during construction of a retaining wall. Receiving channels 130 may also receive horizontal reinforcing materials such as rebar during the construction of a wall. It should be understood that in some applications where the pin hole extends from the top surface through to the bottom surface and where the front face may have a non-beveled (substantially flat) surface, the top and bottom surfaces of block 100 may be reversible. In other words, when block 100 is used in the construction of a wall either top surface 102 or bottom surface 103 may face downward. Thus, the head 52 of pin 50 may then also be received in some applications in the receiving channel as discussed further below. It should be noted that the shape, width and length of the channel can vary depending upon the application and could for example only extend a portion of the length of neck portion 113 or may open onto only one of side walls 106 or 107 or may open onto neither side wall.

Though the blocks illustrated in the FIGS. 1 to 7 may have various dimensions, block 100 typically has a height (i.e., the distance between surfaces 102 and 103) of about 4 inches (102 mm), a body length (i.e., the distance from side wall 106 to side wall 107) of about 12 inches (304 mm) and a width (i.e., the distance from front face 104 to rear face 105) of about 7 inches (178 mm).

An alternate embodiment of the block is shown in FIGS. 10 to 15. Block 200 is substantially similar to block 100 except that pin holes 218 do not open into core 214 and block 200 has been manufactured without receiving channels 130. Block 200 has parallel top surface 202 and bottom surface 203, front face 204, rear face 205 and first and second side walls 206 and 207. Side walls 206 and 207 converge from front face 204 toward rear face 205. Front face 204 may be of a compound shape with angled portions or bevels 211 which are non-orthogonal to side walls 206 and 207 and angled portion or bevel 212 which is non-orthogonal to top surface 202.

Block 200 includes front portion 208, back portion 209 and center portion 210. Block 200 also includes openings or cores 214 and 215 and may extend from top surface 202 to bottom surface 203, or may only extend part of the way through block 200. Cores 214 and 215 may also be utilized as pin receiving cavities. Block 200 also includes neck portions 213 adjacent side walls 206 and 207, extending from front portion 208 to center portion 210 and to back portion 209. First and second pin holes 218 are located in center portion 210 and extend a distance through block 200, open to top surface 202 but closed at bottom surface 203. The pin hole interior surfaces may be tapered from wider to narrower from the top surface to the bottom surface or its interior surfaces may be non-tapered or plumb. It should be noted that additional pin holes can be provided, if desired, so as to provide for further choices of predetermined setback when building a wall. Additionally, the location of the pin holes in the body of the block may be varied as desired and could, for example, be located in front portion 208, back portion 209 or neck portions 213.

Figure 16:
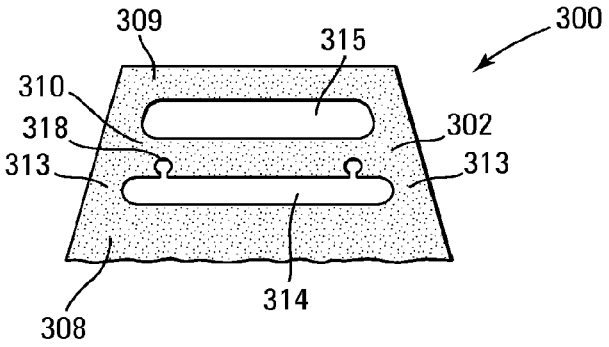
FIGS. 16 to 18 are bottom, top front perspective and top views, respectively, of alternate embodiment of a wall block.
Figure 17:
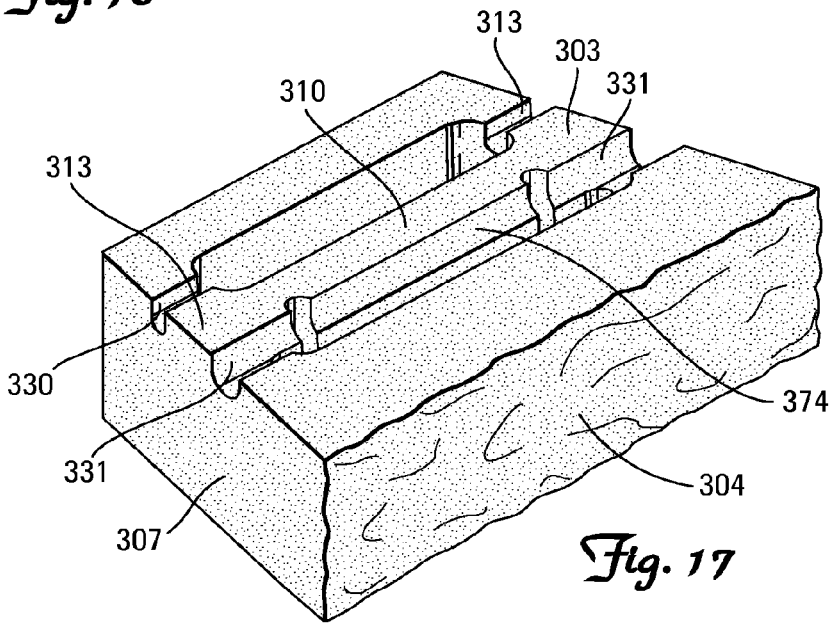
Figure 18:
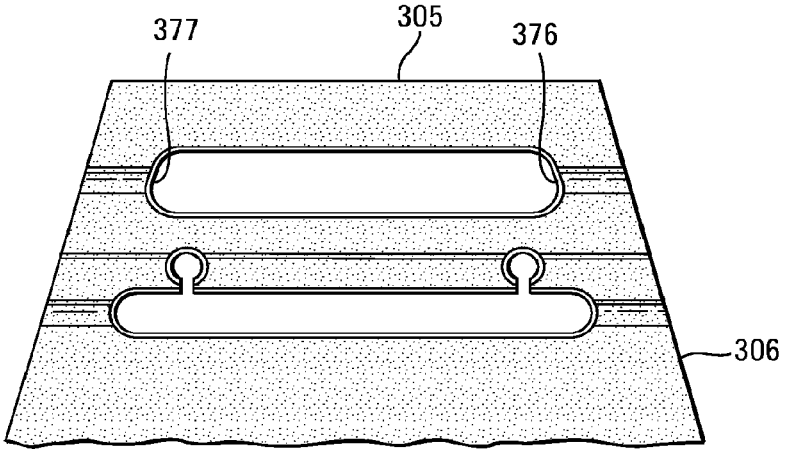

An alternate embodiment of the block is shown in FIGS. 16 to 18. Block 300 has parallel top surface 302 and bottom surface 303, front face 304, rear face 305 and first and second side walls 306 and 307. Side walls 306 and 307 converge from front face 304 toward rear face 305. Front surface 304 could have any desired shape, pattern or texture as desired. Block 300 includes front portion 308, back portion 309 and center portion 310. Block 300 also includes openings or cores 314 and 315 and may extend from top surface 302 to bottom surface 303, or may only extend part of the way through block 300. Cores 314 and 315 may also be utilized as pin receiving cavities. Block 300 also includes neck portions 313 adjacent side walls 306 and 307, extending from front portion 308 to center portion 310 and to back portion 309. First and second pin holes 318 are located in center portion 310 and extend through block 300; open to top surface 302 and bottom surface 303. The pin hole interior surfaces may be tapered from wider to narrower from the bottom surface to the top surface or its interior surfaces may be non-tapered or plumb. It should be noted that additional pin holes can be provided, if desired, so as to provide for further choices of predetermined setback when building a wall. Additionally, the location of the pin holes in the body of the block may be varied as desired and could, for example, be located in front portion 308, back portion 309 or neck portions 313.

Bottom surface 303 has receiving channels 330 located in neck portions 313 and receiving channel 331 in center portion 310. Receiving channels 330 extend from side wall 306 to core side wall 376 of core 315. Receiving channels 330 also extend from side wall 307 to core side wall 377 of core 315. Receiving channel 331 extends from side wall 306 through center portion 310 to side wall 307. Additionally, receiving channel 331 also extends from side wall 306 through rear surface 374 of core 314 to side wall 307. Thus, block 300 includes two channels extending through the entire length of the block body, from sidewall 306 through core 315 and to side wall 307 and from side wall 306 through center portion 310 and core 314 to side wall 307. Receiving channels 330 and 331 located on the top surface 302 are formed from a forming member that is mounted to a side wall or liner of a mold cavity. During the manufacturing of block 300, bottom surface 303 faces up and concrete or other desired material settles around the forming member and is allowed to set, the block is then stripped from the mold cavity, forming receiving channel 330. During construction of a wall with no setback, pins are placed in pin holes 318 of top surface 302 in a laid lower course of blocks 300. The upper portion of the pin or the head of the pin is received in channel 331 of the bottom surface of the upper course of blocks. Receiving channels 330 and 331 may receive horizontal reinforcing materials such as rebar during the construction of a wall. It should be noted that the shape, width and length of the channel can vary depending upon the application and could for example only extend a portion of the length of neck portion 313 or may open onto only one of side walls 306 or 307 or may open onto neither side wall.

Figure 19:
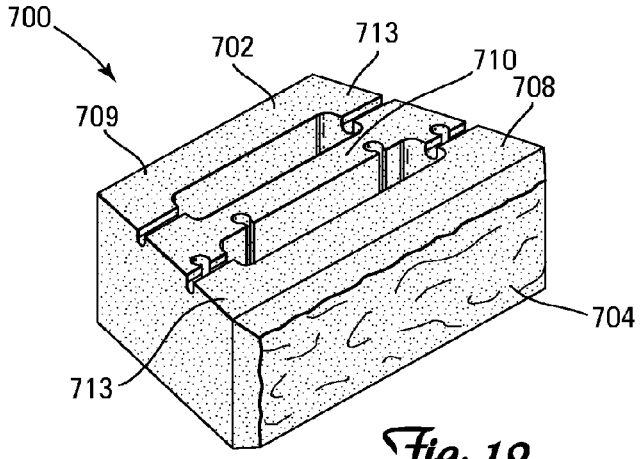
FIGS. 19 to 21 are top front perspective, bottom front perspective and top views, respectively, of alternate embodiment of a wall block.
Figure 20:
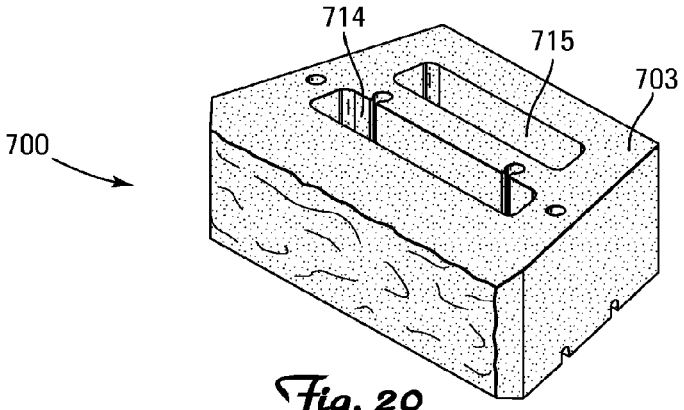
Figure 21:
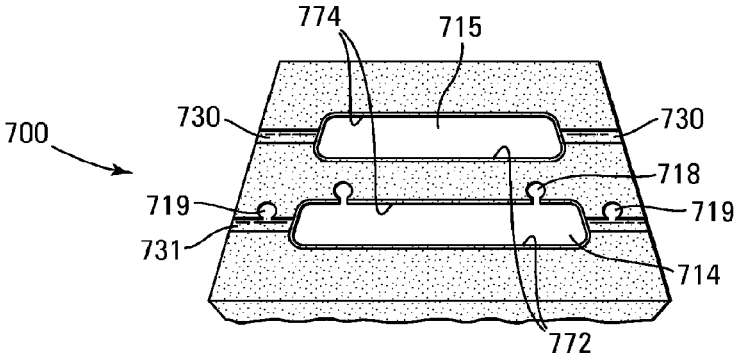
Figure 22:
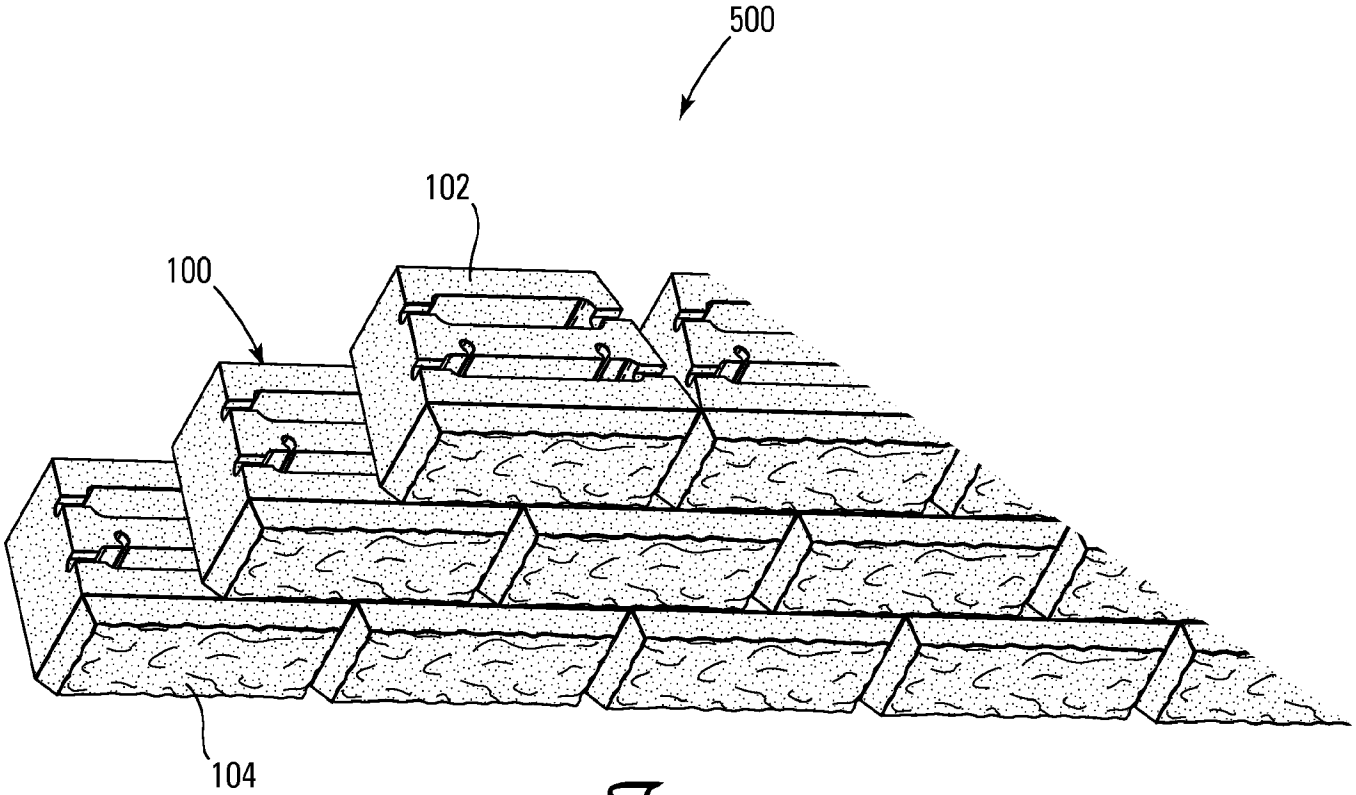
FIGS. 22 to 24 are front perspective, front elevation and cross-sectional side views, respectively, of a wall constructed with the blocks FIGS. 1 to 7.
Figure 23:
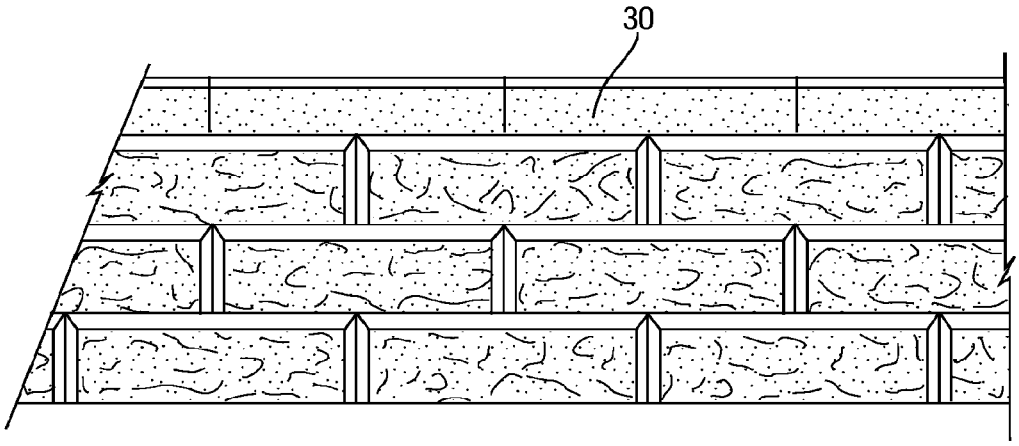

An alternate embodiment of the block is shown in FIGS. 19 to 21. Block 700 is substantially similar to block 100. Front surface 704 may have angular surfaces substantially similar to angular surfaces 111 and 112 of block 100. It is to be understood that front surface 704 could have any desired shape, pattern or texture as desired and could be substantially similar to front surface 304 of block 300. Block 700 includes front portion 708, back portion 709 and center portion 710. Front portion 708 may have a greater surface area than rear portion 709. Rear portion 709 may have a greater surface area than center portion 710. Center portion 710 has a depth from front to back as measured between back surface 774 of core 714 and front surface 772 of core 715 which is less than the depth of back portion 709 as measured between back surface 774 of core 715 and rear face 705 which is less than the depth of front portion 708 as measured from front to back between front face 704 and front surface 772 of core 714. Block 700 also includes openings or cores 714 and 715 and may extend from top surface 702 to bottom surface 703, or may only extend part of the way through block 700. Cores 714 and 715 may have substantially the same shape and may also be utilized as pin receiving cavities. Core 714 has a depth from front to back as measured between faces 772 and 774 that is substantially the same as the depth of core 715. Block 700 also includes neck portions 713 extending from front portion 708 to center portion 710 and to back portion 709. Top surface 703 has receiving channels 730 opening into core 715 and receiving channels 731 opening into core 714. A rear surface of the receiving channel 731 is flush or in the same plane as a rear surface 774 of core 714.

First and second pin holes 718 are located in center portion 710 and extend through block 700; open to top surface 702 and bottom surface 703. First and second pin holes 718 may open onto the rear surface 774 of core 714. First and second pin holes 718 allow for a setback in the construction of a wall utilizing a pinning system with block 700. Third and fourth pin holes 719 are located in receiving channel 731 and extend from the lower surface of receiving channel 731 through block 700 opening onto bottom surface 703. Third and fourth pin holes 719 allow for a substantially vertical (or non-setback) constructed wall utilizing a pinning system with block 700. It should be understood that wall block 700 could be used to construct a wall with top surface 702 facing downward and wherein the receiving channels could also be utilized as pin receiving cavities in the construction of a wall.

It should further be understood that wall block 700 could have any desired dimensions. Block 700 may have, for example, a height (i.e., the distance between surfaces 702 and 703) of about 6 inches (152 mm), a body length of about 16 inches (406 mm) and a width of about 10 inches (254 mm).

FIGS. 22 to 25 illustrate views of retaining wall 500 made from block 100. Wall block 100 is used to form a wall having a front surface. Generally, when constructing a wall, a trench is excavated to a pre-selected depth and partially filled with a level base of granular material such as crushed stone. A base layer of blocks are then placed and leveled onto the crushed stone. The blocks are placed side to side with front face 104 facing outward and the bottom surface 103 facing downward. When the pinning system is utilized, pins 50 are placed into pin hole 118 of the top surface of the blocks as best seen in FIG. 24. The heads 52 of pins 50 are then received in cores 114 in the bottom surface of the upper adjacent course of blocks. Subsequent layers of blocks can then be placed one on top of the next with the pin connection system until the desired height is reached. Once the base layer is laid, the second layer is laid with the bottom surface 103 of the blocks of the second layer placed upon the top surface 102 of the blocks of the base layer. It should be noted that when the block is used in constructing a gravity wall, the weight of the blocks may be sufficient for connection without the use of the pinning system. When the desired height of the wall is achieved a cap or finish layer 30 may be added.

When constructing a wall with geogrid reinforcement material G for walls which need geogrid to add a tensile soil reinforcing element to the mechanically stabilized earth, a base layer of blocks is laid and pins 50 are placed into pin holes 118 of top surface 102 of the blocks 100. The geogrid G may be made from a polyester knitted and/or woven synthetic material with a PVC or substantially similar compound coating, or they can be made with HDPE polyethylene materials. The layering of the geogrid G may be determined by engineering analysis as known in the art. When the type of geogrid has been accurately determined for its specific location in a wall the geogrid G is cut to length and placed over the block. It can be placed either over the connecting pins or the geogrid can be placed on the blocks first, and then the pins are put into the open pin holes on the top surface of the block to connect the geogrid to the blocks. The geogrid soil reinforcement material G is thus connected to pins 50 and pulled taut (towards the backfill embankment). The heads 52 of pins 50 are then received in cores 114 in the bottom surfaces of the upper adjacent course of blocks. The cores of the blocks and 6 inches behind the wall may be filled in with crushed stone for drainage and hydrostatic load bearing of the wall. The crushed stone interlock between courses of wall blocks improves pull out resistance and increases connection strength of the geogrid G. When the desired height of the wall is achieved a cap or finish layer 30 may be added.

Additionally or optionally, it should be understood that the geogrid reinforcement material G may be laid over the desired course of blocks and a channel bar or other geogrid securing means may be inserted into one of the receiving channels 130 of block 100. The geogrid soil reinforcement material may then be pulled towards the backfill embankment securing the channel bar or other geogrid securing means within the receiving channel and an upper adjacent course of blocks may then be laid.

It should further be noted that in some applications having limited or no set back and substantially vertical alignment and the height of the wall is such that the structure need further stabilization, vertical reinforcing members such as rebar, may be threaded through vertical open cores (columnar cavities) created by the cores of blocks as they are stacked one upon the other. It should further be noted that the wall may be constructed with two or more sizes of block as desired for a more random appearance of the wall aesthetic depending upon the application.

Figure 27:
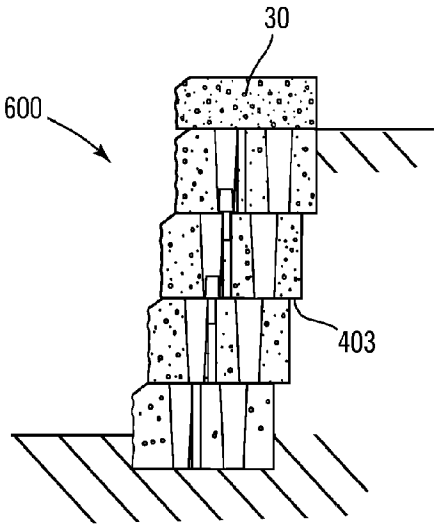
FIGS. 26 and 27 are top front perspective and cross-sectional side views, respectively, of a wall constructed with the blocks of FIG. 28.
Figure 26:
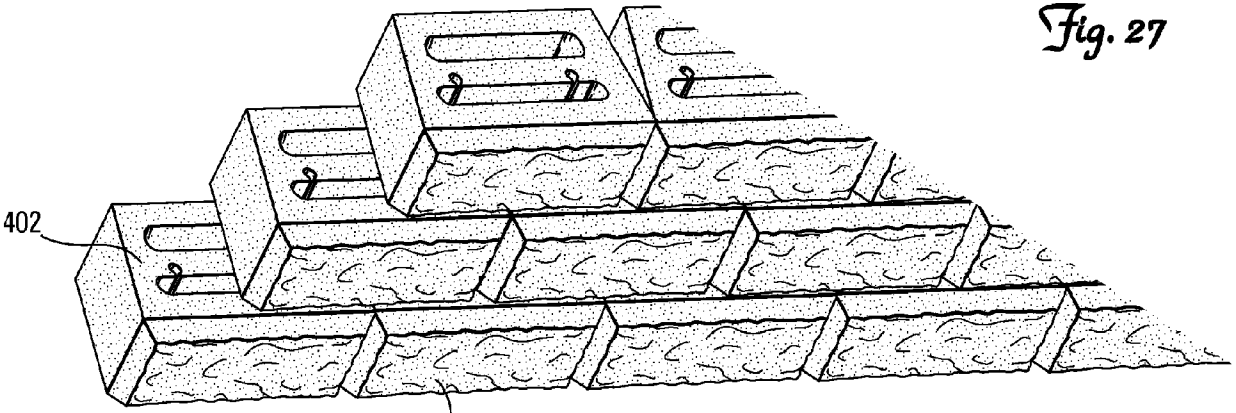
Figure 28:
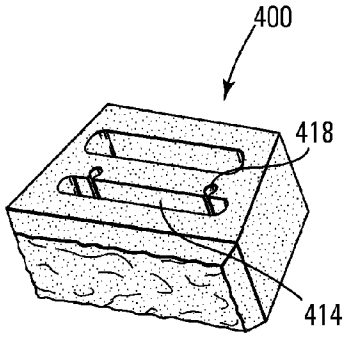
FIG. 28 is a front perspective view of an alternate embodiment of a wall block.

FIGS. 26 to 28 illustrate views of retaining wall 600 made from block 400 which is an alternate embodiment of block 200. Block 400 is substantially similar to block 200 except that pin holes 418 are open to core 414. Wall block 400 is used to form a wall having a front surface. A trench is excavated to a pre-selected depth and is partially filled to approximately 4 inches thick with a level base of granular material such as crushed stone. A base layer is then placed and leveled onto the crushed stone. The blocks are placed side touching side with front face 404 facing outward and the bottom surface 403 facing downward. Once the base layer is laid, the second layer is laid with the bottom surface 403 of the blocks of the second layer placed upon the top surface 402 of the blocks of the base layer. It should be noted that when the block is used in constructing a gravity wall, the weight of the blocks may be sufficient for connection without the use of the pinning system. When the pinning system is utilized, pins 50 are placed into pin hole 418 of the top surface of the blocks. The heads 52 of pins 50 are then received in cores 414 in the bottom surface of the upper adjacent course of blocks. Subsequent layers of blocks can then be placed one on top of the next with the pin connection system until the desired height is reached.

Figure 29:
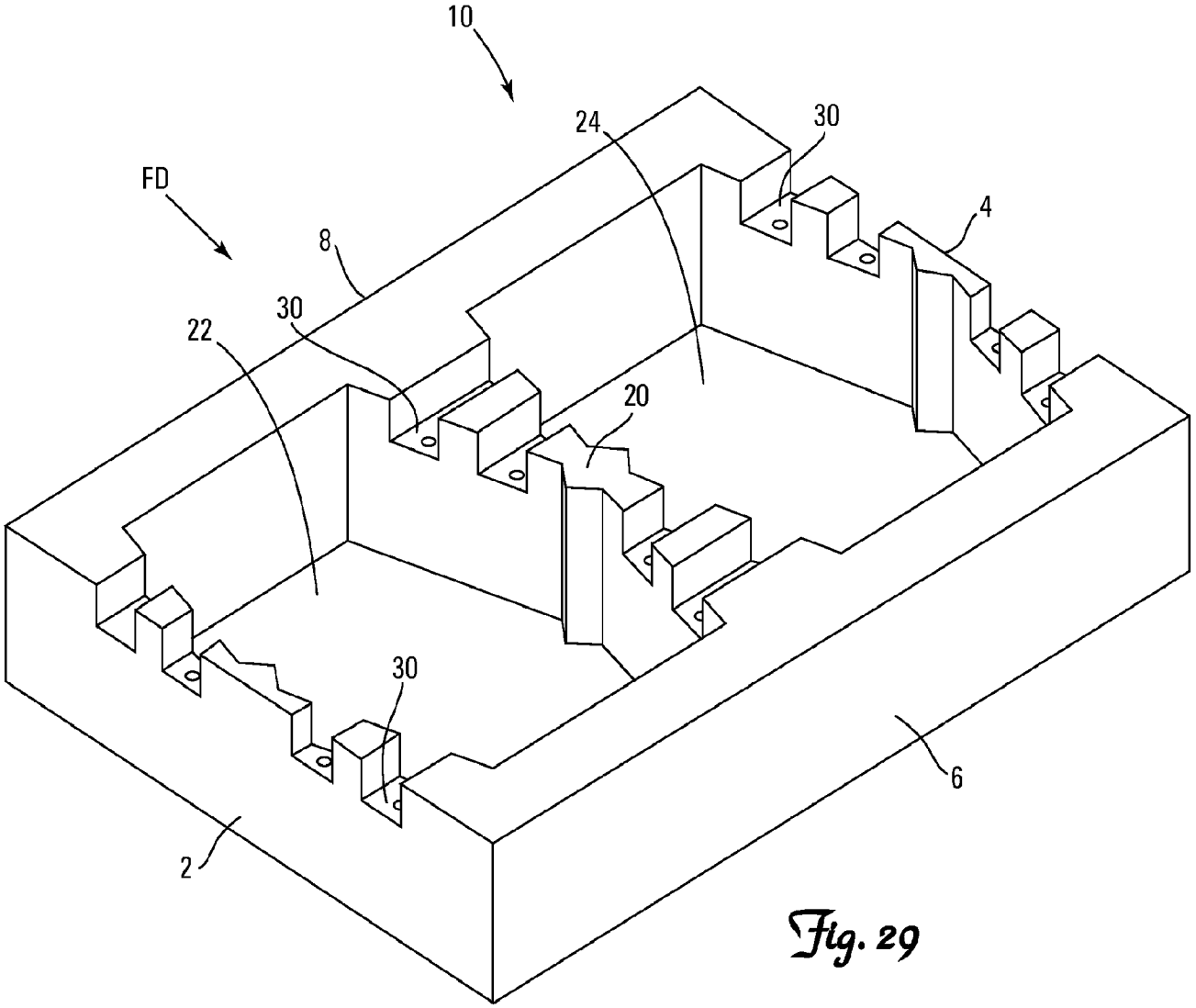
FIGS. 29 to 31 are front perspective views of a mold box, showing the progression of adding support bridge style core elements and their fastening bolts.
Figure 30:
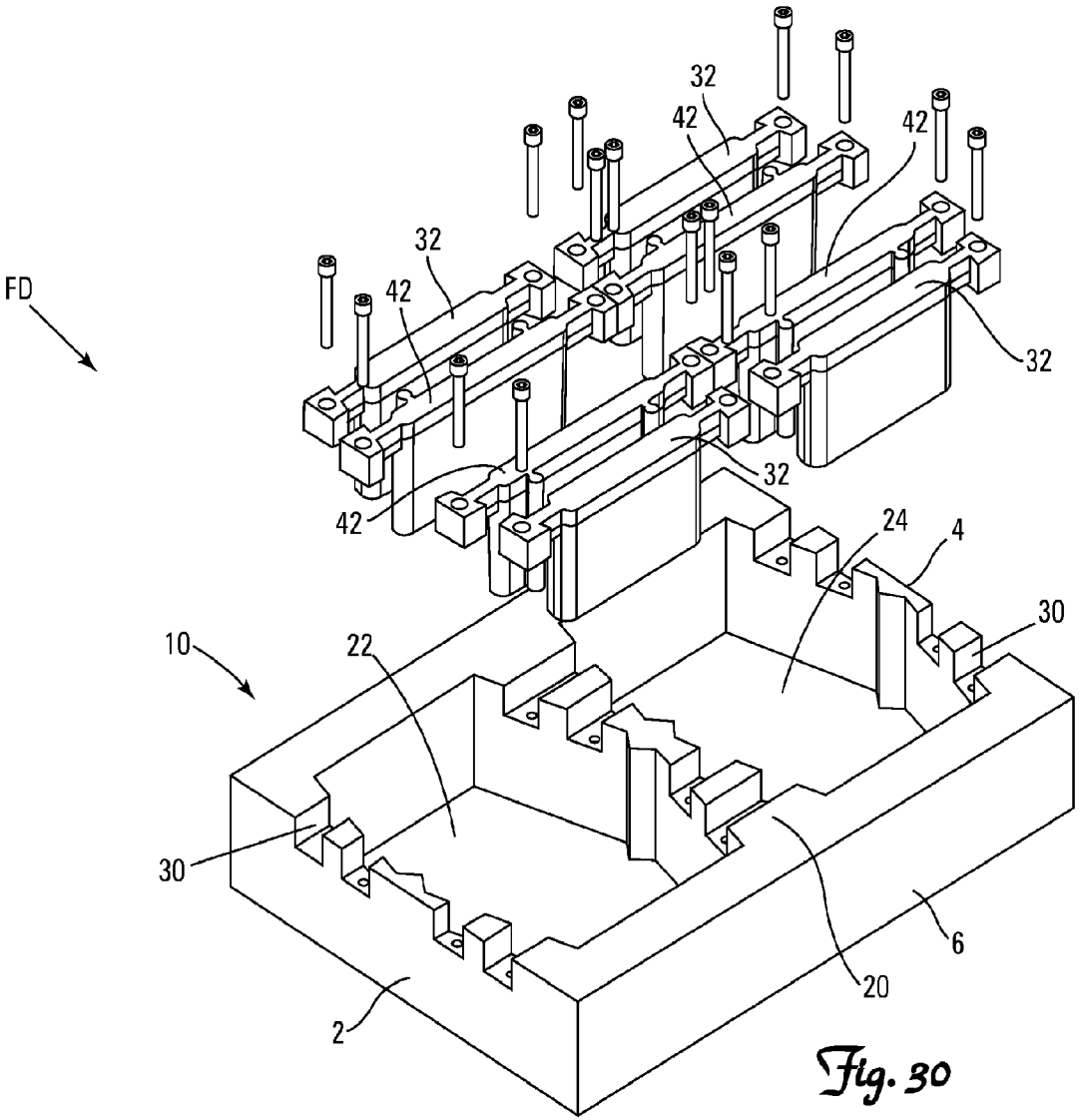
Figure 31:
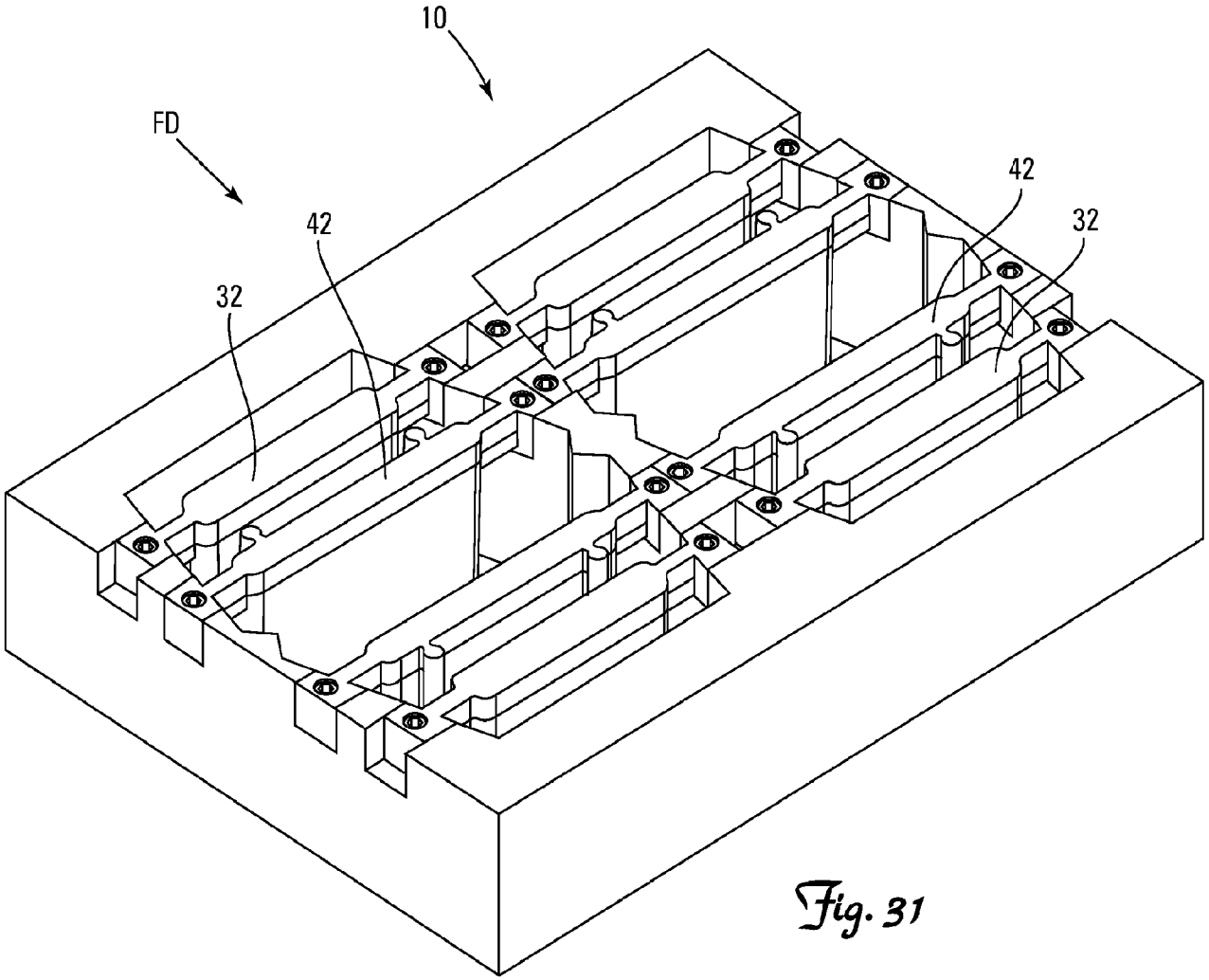

FIGS. 29 to 31 illustrate a multi-block mold box 10. Mold box 10 generally includes opposing first and second side frame walls 2 and 4 and opposing first and second end frame walls 6 and 8. Side frame walls 2 and 4 have a compound shape that may be formed, machined or flame cut during the manufacture of the mold box. Alternatively, the compound shape can be formed by the use of replaceable side liners as is known in the art. Though mold box 10 may have various dimensions, typical dimensions of this mold box are about 18.5 inches (47.0 cm) wide (i.e., the width of both the first and second end walls), 26.0 inches (66.0 cm) long (i.e., the length of both the first and second side walls), and 4 inches (10.2 cm) thick.

Center frame wall 20 spans end frame walls 6 and 8 of mold box 10 and has a compound shape. Center frame wall 20 along with first and second side frame walls 2 and 4 and opposing first and second end frame walls 6 and 8 may be formed, machined or flame cut during the manufacture of the mold box to form a single, continuous and seamless mold. Alternatively, the ends of center frame wall 20 may be securely or removeably fixed to end walls 6 and 8 in a conventional manner and the compound shape may be formed from removeable side liners as is known in the art. Further, first and second side frame walls 2 and 4 and opposing first and second end frame walls 6 and 8 may also be separate pieces that are securely or removeably fixed to one another in a conventional manner. The location of center frame wall 20 defines first and second mold cavities 22 and 24. Mold cavities 22 and 24 form paired blocks or block shapes with identical lengths, heights and widths. The paired blocks are split along their front faces from their opposite or mirror image block after removal from the mold to produce four blocks.

The blocks are oriented in the mold box such that the front faces of the blocks, prior to splitting, are generally parallel to end frame walls 6 and 8 and perpendicular to the direction of travel of the feed drawer and cut-off bar represented in FIGS. 29 and 31 by arrow FD. The feed drawer and cut-off bar are well known to those of skill in the art and are not shown in the drawing figures. Traditionally, cores and/or pin holes are formed in blocks using core bars having core (or pin) forming portions suspended from core bars. The core bars are positioned to be parallel to the direction of travel of the feed drawer to ensure that block forming material is evenly distributed in the mold box and that excess material can be removed by the cut-off bar, which is shaped or notched to accommodate the shape of the core bar, as it travels over the mold box. Core bars placed in the traditional orientation parallel to the direction of travel of the feed drawer do not work well with mold box 10. This is because blocks formed in the mold box of FIGS. 29 to 31 are oriented with their front faces perpendicular to the direction of travel of the feed drawer and cut-off bar and the front face has angled surface 112. If core bars parallel to the direction of travel of the feed drawer were used they would cover portions of the front faces of the blocks and disrupt the compression of material along the front face. Further, they would prevent the stripper shoe (shown and described in connection with FIGS. 36 and 37), and in particular angular surface 96, from forming the angled surface 112. Thus, forming members 32 and 42, as described in connection with FIGS. 27 to 30, and forming members 52 and 62 as described in connection with FIGS. 31 and 32, are used with mold box 10 instead of traditionally oriented core bars.

As shown in FIGS. 30 and 31 forming members 32 and 42 are received in channels or grooves 30 of end frame walls 6 and 8 and center frame wall 20. Channels or grooves 30 may be formed, machined, flame cut or milled into the end walls and center wall. Forming members 32 and 42 may be securely or removeably fixed to end walls 6 and 8 and to center frame wall 20 as shown in FIG. 31 so that top surfaces of the forming members lie generally in the same plane as the top surface of the mold box.

Figure 32:
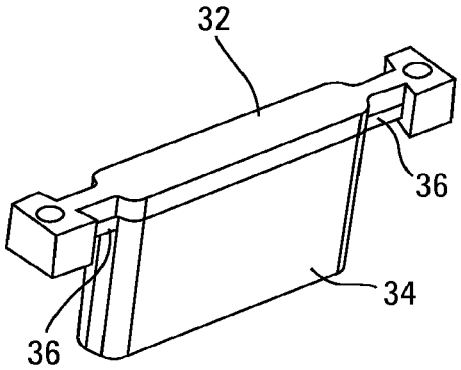
FIGS. 32 to 35 are perspective views and a cross-sectional view of forming members for the mold box.

As can be seen in FIG. 32, forming member 32 has a core forming portion 34 and a channel forming bridge portions 36. Core forming portion 34 molds core 115 of block 100 and may be tapered from a wider dimension at the top of the mold to a narrower dimension at the bottom of the mold creating a draft angle which helps the block strip away from the forming member 32 with greater ease while helping to maintain the integrity of the shape of the core molded from the core forming portion of the forming member 32. Core forming portion 34 may extend the entire height of mold cavities 22 and 24. Channel forming bridge portions 36 mold receiving channels 130 of neck portions 113 adjacent core 115 and can have any shape, width, depth and length as desired. It should be noted that the dimensions of the core forming portions and the channel forming portions are not limiting and could be any desired dimension depending upon the application. Further, core forming portion 34 could be designed to extend any distance through the mold cavity and thus could create a block where core 115 is open to top surface 102 but closed on bottom surface 103.

Figure 33:
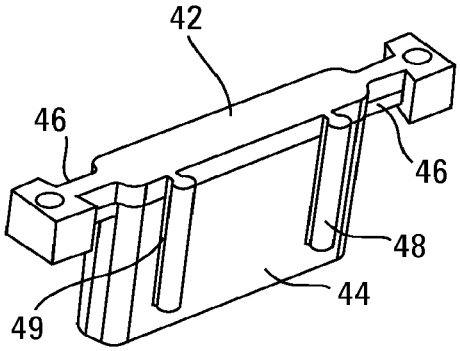

As can be seen in FIG. 33, forming member 42 has core forming portion 44, channel forming bridge portions 46 and pin hole forming portions 48. Pin hole forming portions 48 include narrow spanning portions 49 which extend from the top to the bottom of pin hole forming portions 48. During the block making process the narrow spanning portions 49 form the elongate slots 119 which open from the pin holes into core 114 of block 100. Core forming portion 44 molds core 114 of block 100 and may be tapered from a wider dimension at the top of the mold to a narrower dimension at the bottom of the mold creating a draft angle which helps the block strip away from the forming member 42 with greater ease while helping to maintain the integrity of the shape of the core produced from the core forming portion. Core forming portion 44 may extend the entire height of mold cavities 22 and 24. Channel forming bridge portions 46 mold receiving channel 130 of neck portions 113 adjacent core 114 and can have any shape, width, depth and length as desired. Pin hole forming portions 48 mold pin holes 118 of block 100 and may also be tapered from a wider dimension at the top of the mold to a narrower dimension towards the bottom of the mold creating a draft angle which helps the block strip away from the forming member 42 with greater ease from the block or slug while helping to maintain the integrity of the shape of the pin hole molded from the pin hole forming portion of the forming member 42. Pin hole forming portions 48 extend a portion of the width of mold box cavities 22 and 24. It should be noted that the dimensions of the core forming portions, the channel forming portions and pin hole forming portions are not limiting and could be any desired dimension depending upon the application. Further, core forming portion 46 could be designed to extend any distance through the mold cavity and thus could create a block where core 115 is open to top surface 102 but closed on bottom surface 103. Alternatively, pin hole forming portion 48 could be designed to extend any distance through the mold cavity and thus could mold a pine hole 118 that is open to top surface 102 and bottom surface 103.

Figure 34:
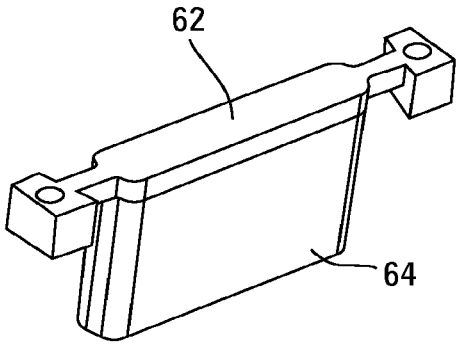
Figure 35:
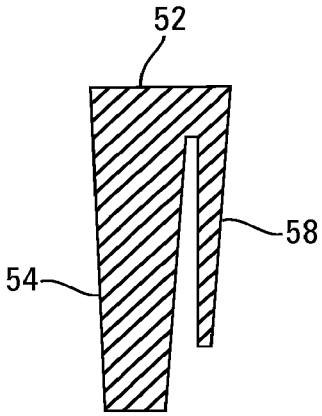

FIGS. 34 and 35 illustrate alternate embodiments of forming members used to produce block 200. Forming member 52 shown in FIG. 35 has core forming portion 54, and pin hole forming portions 58. FIG. 35 is a cross-sectional view of forming member 52 through one of the pin hole forming portions 58 and core forming portion 54. Forming member 54 is different from forming member 42 in that the spanning portion connecting the pin hole forming portion to the core forming portion does not extend to the bottom of the pin hole forming portion. Therefore, the pin holes formed by pin hole forming portions 58 do not open into a core, or at least do not open into a core of the block along the entire length of the pin hole. Core forming portion 54 molds core 214 of block 200 and may be tapered from wider at the top of the mold to narrower at the bottom of the mold cavity. Core forming portion 54 may extend the entire width of mold cavities 22 and 24. Pin hole forming portion 58 molds pin holes 218 of block 200 and may also be tapered from a wider dimension at the top of the mold to a narrower dimension towards the bottom of the mold. Pin hole forming portion 58 extends a portion of the width of mold box cavities 22 and 24. It should be noted that the dimensions of the core forming portions and pin hole forming portions are not limiting and could be any desired dimension depending upon the application. Further, core forming portion 56 could be designed to extend any distance through the mold cavity and thus could create a block where core 215 is open to top surface 202 but closed on bottom surface 203. Alternatively, pin hole forming portion 58 could be designed to extend any distance through the mold cavity and thus could mold a pine hole 218 that is open to top surface 202 and bottom surface 203.

Forming member 62 has core forming portion 64. Core forming portion 64 molds core 215 of block 200 and may be tapered from a wider dimension at the top of the mold to a narrower dimension at the bottom of the mold. It should be noted that the dimensions of the core forming portion is not limiting and could be any desired dimension depending upon the application. Further, core forming portion 64 could be designed to extend any distance through the mold cavity and thus could create a block where core 215 is open to top surface 202 but closed on bottom surface 203. Forming member 62 is substantially similar to forming member 32 except that it does not have channel forming bridge portions 36.

Mold box 10 is configured to rest upon a pallet to form mold cavities 22 and 24. Masonry material is deposited into cavities 22 and 24 by the feed drawer as it passes over the mold box. Excess material is removed by the cut-off bar as the feed drawer moves away from the mold box so that the masonry material is level with the top of the mold box and the top surfaces of the forming members. Next, stripper shoes (shown and described in connection with FIGS. 36 and 37) from a head assembly contact the masonry material from above, compresses it, form angled surfaces 112 and 212, and then pushes it through the mold while the mold is held firmly in a stationary position in the mold machine in accordance with procedures well known to those of skill in the art.

Figure 36:
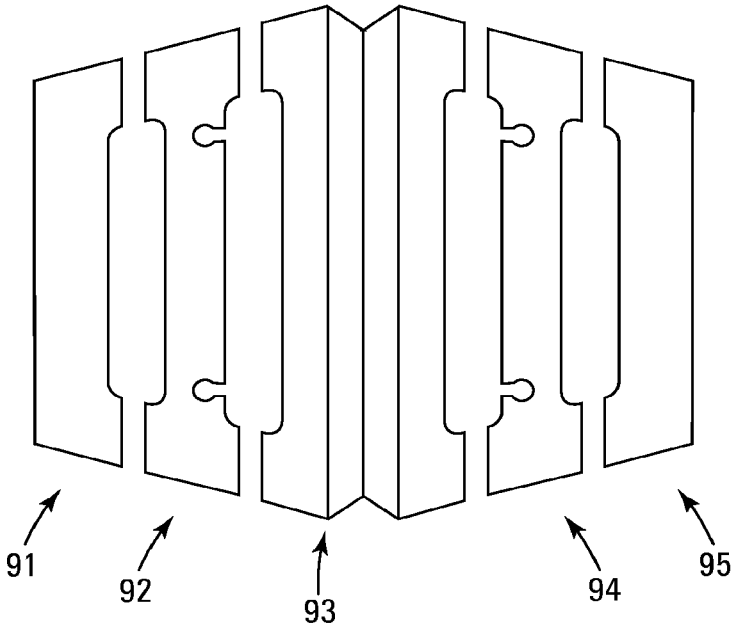
FIGS. 36 and 37 are top and side views of stripper shoe plates that compact, compress and push masonry material through a mold box.
Figure 37:
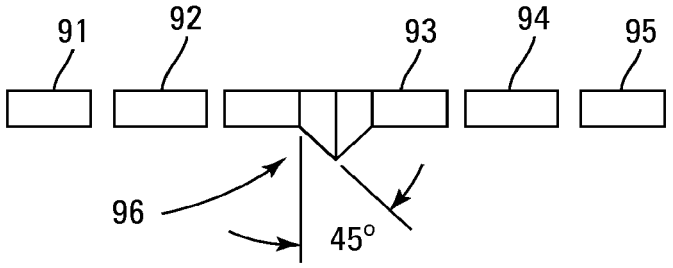

FIGS. 36 and 37 illustrate top and side views respectively of stripper shoe plates 91, 92, 93, 94 and 95 that contact, compress and push the masonry material through the mold box. The stripper shoe plates may be manufactured to contact the masonry material only and may have voids or open spaces where any forming members are located in the mold box. Stripper shoe plate 93 has angular surfaces 96 that contact and compress the masonry material in the mold box. Angular surfaces 96 of stripper shoe 93 imprint angled surfaces 112 and 212 onto blocks 100 and 200. Angular surfaces 96 may extend from the bottom surface of stripper shoe 93 at any desired slope or angle as desired depending upon the block being manufactured and could be 45 degrees.

The masonry material used in the production of the blocks typically is a rugged, weather resistant material; preferably (and typically) zero-slump molded concrete. Other suitable materials include wet cast concrete, plastic, reinforced fibers, wood, metal, composite materials such as fiberglass or polymers, and stone. A vibratory action and stripper shoes on the mold head assembly can compress the material contained within the mold cavities.

It should be understood that the mold box could be configured to impart any desired face shape, texture or pattern onto any or all side, front and back surfaces of the blocks. The mold box could be configured to have separate mold cavities for each block produced in the mold box, thus the front face could be manufactured with any desired pattern texture or shape and when stripped from the mold cavity would not need to be split like the paired block produced in mold cavities 22 and 24 of mold box 10. A desired pattern, texture or shape may be formed, machined or flame cut onto any or all of the desired surface(s) of the mold box to form or impart the pattern, texture or shape onto the surface of the block being manufactured. Additionally and/or alternatively, the texture, pattern or shape can be formed by the use of replaceable side, back and front liners as is known in the art.

Although particular embodiments have been disclosed herein in detail, this has been done for purposes of illustration only, and is not intended to be limiting with respect to the scope of the appended claims, which follow. In particular, it is contemplated by the inventor that various substitutions, alterations, and modifications may be made to the invention without departing from the spirit and scope of the invention as defined by the claims. For instance, the choice of materials or variations in the shape or angles at which some of the surfaces intersect are believed to be a matter of routine for a person of ordinary skill in the art with knowledge of the embodiments disclosed herein.

What is claimed is:

1. A wall block comprising:

a block body having opposed front and rear faces, opposed and substantially parallel top and bottom surfaces, and opposed first and second side walls that converge from the front face toward the rear face such that a total surface area of the front face is greater than a total surface area of the rear face;

at least one core extending from the top surface to the bottom surface, the at least one core having opposed front and rear surfaces and opposed first and second side surfaces, the front surface of the core being positioned in closer proximity to the front face of the block body than the rear surface of the core and the first side surface of the core being positioned in closer proximity to the first side wall of the block body than the second side surface of the core;

at least a first and second pin hole opening onto the top surface and the bottom surface of the block body and extending the distance from the top surface to the bottom surface of the block body, the first pin hole opening onto at least one surface of the at least one core through a first core slot and the second pin hole opening onto at least one surface of the at least one core through a second core slot, the first and second core slots extending the entire distance from an uppermost top surface to a lowermost bottom surface of the block body, the first and second pin holes having a maximum lateral width as measured in a direction from the first side wall to the second side wall, the first and second core slots having a maximum lateral width smaller than the maximum lateral width of the first and second pin holes along the entire distance from the uppermost top surface to the lowermost bottom surface of the block body, such that each pin hole is sized to accept a pin and each core slot is sized to retain the pin in the pin hole and to prevent displacement of the pin into the core; and at least a third and fourth pin hole opening to the top surface and the bottom surface of the block body and being closed to the at least one core, the third pin hole being positioned between the first side surface of the at least one core and the first side wall of the block body and the fourth pin hole being positioned between the second side surface of the at least one core and the second side wall of the block body.

2. The wall block of claim 1 wherein the at least one core is two cores having opposed front and rear surfaces and opposed first and second side surfaces, the first core being positioned in closer proximity to the front face of the block body than the second core and the second core being positioned in closer proximity to the rear face of the block body than the first core, and the first core having a larger maximum lateral width than the second core.

3. The wall block of claim 2 wherein the first pin hole opens onto the front surface of the second core through the first core slot and the second pin hole opens onto the front surface of the second core through the second core slot.

4. The wall block of claim 2 wherein the first pin hole opens onto the rear surface of first core through the first core slot and the second pin hole opens onto the rear surface of the first core through the second core slot.

5. The wall block of claim 2 wherein the top surface has an elongate channel extending from the first side wall to the second side wall of the block body.

6. The wall block of claim 5 wherein the at least third and fourth pin holes and the first core are open to the elongate channel.

7. The wall block of claim 2 wherein the top surface has a first and a second elongate channel, the first elongate channel extending from the first side surface of the first core to the first side wall of the block body and the second elongate channel extending from the second side surface of the first core to the second side wall of the block body.

8. The wall block of claim 7 wherein the top surface has a third and a fourth elongate channel, the third elongate channel extending from the first side surface of the second core to the first side wall of the block body and the fourth elongate channel extending from the second side surface of the second core to the second side wall of the block body.

9. The wall block of claim 1 wherein the front face has an angular surface that is adjacent and non-orthogonal to the top surface.

10. The wall block of claim 9 wherein the front face has a first side angular surface adjacent and non-orthogonal to the first side wall of the block body and a second side angular surface adjacent and non-orthogonal to the second side wall of the block body.

11. A wall block system comprising:

at least one wall block having a block body with opposed front and rear faces, opposed top and bottom surfaces, and opposed first and second side walls that converge from the front face toward the rear face such that a total surface area of the front face is greater than a total surface area of the rear face, the at least one wall block having at least one core extending from the top surface to the bottom surface, the at least one core having opposed front and rear surfaces and opposed first and second side surfaces, the front surface of the core being positioned in closer proximity to the front face of the block body than the rear surface of the core and the first side surface of the core being positioned in closer proximity to the first side wall of the block body than the second side surface of the core, the at least one wall block having at least a first and second pin hole opening onto the top surface and the bottom surface of the block body and extending the distance from the top surface to the bottom surface of the block body, the first pin hole opening onto at least one surface of the at least one core through a first core slot and the second pin hole opening onto at least one surface of the at least one core through a second core slot, the first and second core slots extending the entire distance from an uppermost top surface to a lowermost bottom surface of the block body, the first and second pin holes having a maximum lateral width as measured in a direction from the first side wall to the second side wall, the first and second core slots having a maximum lateral width smaller than the maximum lateral width of the first and second pin holes along the entire distance from the uppermost top surface to the lowermost bottom surface of the block body, such that each pin hole is sized to accept a pin and each core slot is sized to retain the pin in the pin hole and to prevent displacement of the pin into the core and at least a third and fourth pin hole opening to the top surface and the bottom surface of the block body and being closed to the at least one core, the third pin hole being positioned between the first side surface of the at least one core and the first side wall of the block body and the fourth pin hole being positioned between the second side surface of the at least one core and the second side wall of the block body.

12. The wall block system of claim 11 wherein the at least one core of the at least one wall block is two cores having opposed front and rear surfaces and opposed first and second side surfaces, the first core being positioned in closer proximity to the front face of the block body than the second core and the second core being positioned in closer proximity to the rear face of the block body than the first core, and the first core having a larger maximum lateral width than the second core.

13. The wall block system of claim 12 wherein the first pin hole opens into the rear surface of the first core through the first core slot and the second pin hole opens into the rear surface of the first core through the second core slot.

14. The wall block system of claim 11 further comprising:

at least one pin being shaped to be received in at least one pin hole of the at least one wall block.

15. A wall having at least a first course and a second course of wall blocks comprising:

a plurality of wall blocks having a block body with opposed front and rear faces, opposed top and bottom surfaces, and opposed first and second side walls that converge from the front face toward the rear face such that a total surface area of the front face is greater than a total surface area of the rear face, at least one of the plurality of wall blocks having at least one core extending from the top surface to the bottom surface, the at least one core having opposed front and rear surfaces and opposed first and second side surfaces, the front surface of the core being positioned in closer proximity to the front face of the block body than the rear surface of the core and the first side surface of the core being positioned in closer proximity to the first side wall of the block body than the second side surface of the core, the at least one of the plurality of wall blocks having at least a first and second pin hole opening onto the top surface and the bottom surface of the block body and extending the distance from the top surface to the bottom surface of the block body, the first pin hole opening onto at least one surface of the at least one core through a first core slot and the second pin hole opening onto at least one surface of the at least one core through a second core slot, the first and second core slots extending the entire distance from an uppermost top surface to a lowermost bottom surface of the block body, the first and second pin holes having a maximum lateral width as measured in a direction from the first side wall to the second side wall, the first and second core slots having a maximum lateral width smaller than the maximum lateral width of the first and second pin holes along the entire distance from the uppermost top surface to the lowermost bottom surface of the block body, such that each pin hole is sized to accept a pin and each core slot is sized to retain the pin in the pin hole and to prevent displacement of the pin into the core and at least a third and fourth pin hole opening to the top surface and the bottom surface of the block body and being closed to the at least one core, the third pin hole being positioned between the first side surface of the at least one core and the first side wall of the block body and the fourth pin hole being positioned between the second side surface of the at least one core and the second side wall of the block body.

16. The wall of claim 15 wherein the first pin hole of the at least one of the plurality of wall blocks opens into the rear surface of the core through the first core slot and the second pin hole of the at least one of the plurality of wall blocks opens into the rear surface of the core through the second core slot.

17. The wall of claim 15 further comprising:

a plurality of pins being shaped to be received in the pin holes of the at least one of the plurality of wall blocks.

* * * * *